US011583726B2

(12) United States Patent
Tracy

(10) Patent No.: US 11,583,726 B2
(45) Date of Patent: Feb. 21, 2023

(54) EXERCISE MACHINE

(71) Applicant: NAUTILUS, INC., Vancouver, WA (US)

(72) Inventor: Jeffrey A. Tracy, Troutdale, OR (US)

(73) Assignee: NAUTILUS, INC., Vancouver, WA (US)

( * ) Notice: Subject to any disclaimer, the term of this patent is extended or adjusted under 35 U.S.C. 154(b) by 300 days.

(21) Appl. No.: 16/760,832

(22) PCT Filed: Oct. 30, 2018

(86) PCT No.: PCT/US2018/058150

§ 371 (c)(1),
(2) Date: Apr. 30, 2020

(87) PCT Pub. No.: WO2019/089547

PCT Pub. Date: May 9, 2019

(65) Prior Publication Data

US 2020/0346069 A1 Nov. 5, 2020

Related U.S. Application Data

(60) Provisional application No. 62/579,689, filed on Oct. 31, 2017.

(51) Int. Cl.
*A63B 22/06* (2006.01)
*A63B 22/00* (2006.01)

(52) U.S. Cl.
CPC ..... *A63B 22/0664* (2013.01); *A63B 22/001* (2013.01); *A63B 22/0015* (2013.01); *A63B 22/0056* (2013.01); *A63B 2022/0682* (2013.01)

(58) Field of Classification Search
CPC .... A63B 22/001; A63B 22/0015–0023; A63B 22/0664–2022/0688; A63B 22/0048–2022/0074
See application file for complete search history.

(56) References Cited

U.S. PATENT DOCUMENTS 6,090,014 A * 7/2000 Eschenbach ..... A63B 22/0023 482/52
6,168,552 B1 * 1/2001 Eschenbach ..... A63B 22/001 482/52
9,498,672 B1 * 11/2016 Miller ..... A63B 22/0664
2005/0277519 A1 12/2005 Moon
2009/0111663 A1 * 4/2009 Kuo ..... A63B 22/001 482/53

(Continued)

*Primary Examiner* — Jennifer Robertson
(74) *Attorney, Agent, or Firm* — Dorsey & Whitney LLP

(57) ABSTRACT

An exercise machine is provided. The exercise machine may include a frame, an adjustment assembly coupled to the frame and selectively movable relative thereto, a foot linkage arranged to reciprocally move in a closed loop path, and a handle linkage arranged to reciprocally move in a defined path. The adjustment assembly may include a pivot axis. The foot linkage may be pivotably coupled to the adjustment assembly at the pivot axis such that selective movement of the pivot axis relative to the frame alters the closed loop path of the foot linkage in use. Movement of one of the foot linkage and the handle linkage may cause corresponding movement of the other of the foot linkage and the handle linkage Actuation of the adjustment assembly may selectively move the pivot axis in more than one direction.

20 Claims, 12 Drawing Sheets

(56) References Cited

U.S. PATENT DOCUMENTS

2012/0322624 A1 12/2012 Wu
2015/0057129 A1* 2/2015 Lo ..... A63B 22/0664
482/52

* cited by examiner

EXERCISE MACHINE

CROSS-REFERENCE TO RELATED APPLICATIONS

This application is a national stage application of International Patent Application No. PCT/US2018/058150 filed on Oct. 30, 2018 and entitled "Exercise Machine" which claims priority to Provisional Patent Application No. 62/579,689 filed on Oct. 31, 2017 and entitled "Exercise Machine", the entire contents of which are hereby incorporated by reference herein in their entireties.

TECHNICAL FIELD

The present disclosure relates generally to physical fitness and personal training and more specifically to an exercise machine.

BACKGROUND

Various devices and systems exist to perform a variety of fitness training exercises. As an example, elliptical machines exist to work the cardiovascular system and/or strength endurance of a user as part of a strength or fitness program. These elliptical machines, however, can be bulky and may not be easily adjustable to a particular user.

It is therefore desirable to provide an improved exercise machine that addresses at least in part the above described problems and/or which more generally offers improvements or an alternative to existing arrangements.

SUMMARY

The present disclosure generally provides an exercise machine. The exercise machine is adjustable to vary an exercise characteristic of the exercise machine depending on user preference. For example, the exercise machine may be adjusted to a fit a particular user. In some embodiments, the exercise machine may be adjusted to vary the exercise movement provided to the user. The exercise machine may include an adjustment assembly operable to vary the relative geometries of various linkage assemblies.

Embodiments of the present disclosure may include an exercise machine. The exercise machine may include a frame, an adjustment assembly coupled to the frame and selectively movable relative thereto, a foot linkage arranged to reciprocally move in a closed loop path, and a handle linkage arranged to reciprocally move in a defined path. The adjustment assembly may include a pivot axis. The foot linkage may be pivotably coupled to the adjustment assembly at the pivot axis such that selective movement of the pivot axis relative to the frame alters the closed loop path of the foot linkage in use. Movement of one of the foot linkage and the handle linkage may cause corresponding movement of the other of the foot linkage and the handle linkage. Actuation of the adjustment assembly may selectively move the pivot axis in more than one direction.

Embodiments of the present disclosure may include an exercise machine. The exercise machine may include a frame including a mast positioned adjacent the front of the exercise machine, a lever arm pivotally connected to the mast such that a first end of the lever arm is selectively moved towards or away from the mast, a crank rotatably mounted to the mast about a crank axis, first and second reciprocating members operatively associated with the crank to rotate about a respective pivot axis, first and second foot links operatively associated with the first and second reciprocating members, respectively, and first and second swing arms pivotally connected to the first end of the lever arm and operatively associated with the first and second foot links. The pivot axes may orbit the crank axis upon rotation of the crank. Each of the first and second foot links may be arranged to move in a respective closed loop path. Selective movement of the first end of the lever arm towards or away from the mast may alter the closed loop paths of the first and second foot links.

Embodiments of the present disclosure may include an exercise machine. The exercise machine may include a frame, a lever arm pivotally connected to the frame and selectively positioned relative to the frame, a crank rotatably mounted to the frame about a crank axis, first and second crank arms coupled to the crank and rotatable about the crank axis, first and second reciprocating members each including opposing first and second ends, first and second foot links respectively coupled to the first and second reciprocating members and arranged to reciprocally move in respective closed loop paths, and first and second swing arms respectively coupled to the first and second foot links and to the lever arm to control the reciprocating movement of the first and second foot links. The first end of each reciprocating member may be pivotably coupled to a respective crank arm. The second end of each reciprocating member may be arranged to reciprocally engage the frame at a position rearward from the crank.

Additional embodiments and features are set forth in part in the description that follows, and will become apparent to those skilled in the art upon examination of the specification and drawings or may be learned by the practice of the disclosed subject matter. A further understanding of the nature and advantages of the present disclosure may be realized by reference to the remaining portions of the specification and the drawings, which forms a part of this disclosure.

One of skill in the art will understand that each of the various aspects and features of the disclosure may advantageously be used separately in some instances, or in combination with other aspects and features of the disclosure in other instances. Accordingly, while the disclosure is presented in terms of embodiments, it should be appreciated that individual aspects of any embodiment can be claimed separately or in combination with aspects and features of that embodiment or any other embodiment. The present disclosure of certain embodiments is merely exemplary in nature and is in no way intended to limit the claimed invention or its applications or uses. It is to be understood that other embodiments may be utilized and that structural and/or logical changes may be made without departing from the spirit and scope of the present disclosure.

The present disclosure is set forth in various levels of detail in this application and no limitation as to the scope of the claimed subject matter is intended by either the inclusion or non-inclusion of elements, components, or the like in this summary. In certain instances, details that are not necessary for an understanding of the disclosure or that render other details difficult to perceive may have been omitted. Moreover, for the purposes of clarity, detailed descriptions of certain features will not be discussed when they would be apparent to those with skill in the art so as not to obscure the description of the present disclosure. It should be understood that the claimed subject matter is not necessarily limited to the particular embodiments or arrangements illustrated herein, and the scope of the present disclosure is defined only by the appended claims.

BRIEF DESCRIPTION OF THE DRAWINGS

The description will be more fully understood with reference to the following figures in which components may not be drawn to scale, which are presented as various embodiments of the exercise machine described herein and should not be construed as a complete depiction of the scope of the exercise machine.

DETAILED DESCRIPTION

Figure 1:
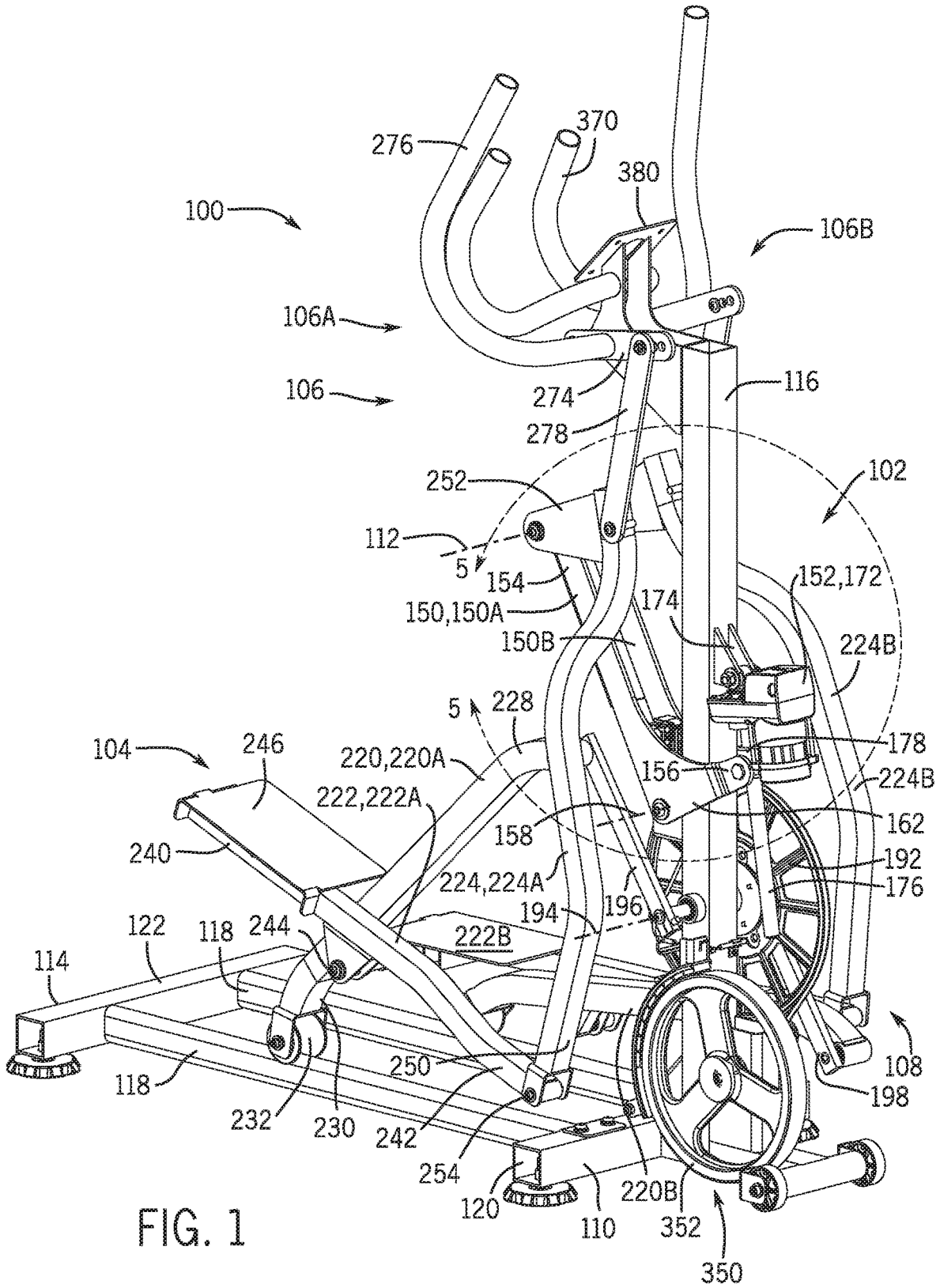
FIG. 1 is a front isometric view of an exercise machine.

FIGS. 1-6 illustrate an exemplary embodiment of an exercise machine 100 including an adjustment assembly 102 operable to vary an exercise characteristic of the exercise machine 100 as desired. As detailed below, the adjustment assembly 102 may allow a user to tailor the exercise machine 100 to provide a desired exercise characteristic. For example, the adjustable nature of the exercise machine 100 may allow a user to customize the exercise machine 100 to suit the needs and/or body size of the user. For example, as explained more fully below, the adjustment assembly 102 may allow the user to adjust the motion of the exercise machine 100, such as providing a longer striding motion for larger-framed users and/or providing a shorter striding motion for smaller-framed users. Additionally or alternatively, the adjustment assembly 102 may allow the user to vary the motion of the exercise machine 100 to selectively target desired muscle groups and/or perform desired functional movements. For instance, as detailed below, the adjustment assembly 102 may allow the user to vary between a more horizontal walking or running motion and a more vertical stair stepping motion. Such a configuration may be beneficial to allow the user to adjust the exercise machine 100 to provide a more natural and/or comfortable geometric motion of the ankle and knees to minimize stress on these joints yet permitting cardiovascular exercise. The adjustment assembly 102 may be adjusted manually by the user, such as prior to performing a desired exercise, or may be adjusted automatically, such as automatically during an exercise program, as more fully explained below. The exercise machine 100 may be substantially any type of exercise machine 100. However, for ease of reference and without intent to limit, the exercise machine 100 will be described below with reference to an elliptical machine. It is understood that the concepts described herein may be applied to other types of exercise devices, such as stationary bicycles or stair steppers, among others, where applicable.

Referring to FIGS. 1-6, an embodiment of the exercise machine 100 may include an adjustment assembly 102, a foot linkage 104, a handle linkage 106, a coupling system 108, and a frame 110. The coupling system 108 is mounted to the frame 110 and to one portion of the foot linkage 104 to control the motion of that portion of the foot linkage 104. The adjustment assembly 102 is mounted to the frame 110 and to another portion of the foot linkage 104 to control the position and/or motion of that portion of the foot linkage 104. The handle linkage 106, which may be an optional element of the exercise machine 100, is coupled to the frame 110 and to the adjustment assembly 102 to control the position and/or motion of that portion of the handle linkage 106.

As described herein, the adjustment assembly 102 is selectively positioned relative to the frame 110 to alter certain geometries of the exercise machine 100 to provide a desired characteristic of the exercise machine 100, such as those provided above or introduced below. For example, the adjustment assembly 102 may move relative to the frame 110 between various configurations (see FIGS. 3 and 4), which may be discrete positions defined by preset engagements or substantially any position between opposing limits. As the adjustment assembly 102 is selectively positioned relative to the frame 110 the motion of the foot linkage 104 and/or the handle linkage 106 may change to provide a desired exercise characteristic. In one example, such as is shown in FIGS. 3 and 4, the adjustment assembly 102 may be positioned relative to the frame 110 by being moved in a forwardly direction or in a rearwardly direction. Positioning the adjustment assembly 102 forwardly on the frame 110 may selectively adjust the exercise machine 100 in a first manner, such as lengthening the stride of the exercise machine 100, among others. Positioning the adjustment assembly 102 rearwardly on the frame 110 may selectively adjust the exercise machine 100 in a second manner, such as shortening the stride of the exercise machine 100, among others. As shown in FIGS. 1, 2, 5, and 6, the adjustment assembly 102 may include a pivot axis 112. In some embodiments, the pivot axis 112 may be selectively positioned relative to the frame 110 to alter the geometries, and thereby the motion of the exercise machine 100. For example, other components of the exercise machine 100 may be associated with the pivot axis 112 such that movement of the pivot axis 112 relative to the frame 110 adjusts the motion of the exercise machine 100 during use.

As shown in FIGS. 1-4, the frame 110 may include a base 114 and a mast 116 extending from the base 114. In one embodiment, the base 114, which may define the front and rear of the exercise machine 100, may be arranged to rest on a support surface (e.g., floor). In such embodiments, the mast 116 may extend substantially vertically from the base 114. Depending on the particular embodiment, the mast 116 may extend substantially perpendicular to the base 114 (see FIG. 3), or may extend at a non-perpendicular angle to the base 114, such as at an acute or obtuse angle to the base 114. The mast 116 may extend from the base 114 at any position between the front and rear of the exercise machine 100. However, for the purposes explained below, the mast 116 is preferably positioned adjacent the front of the exercise machine 100. Such embodiments may provide a more compact exercise machine in combination with other components discussed below. As described herein, the exercise machine 100 includes a single mast 116 extending from the base 114. However, there may be more than one mast 116, or another structure replacing the function of the mast 116 may be used, such as a horizontal frame member supported by one or more column frame members.

As shown in FIGS. 1-4, the base 114 may include a plurality of guide rails 118 that help define the motion of the exercise machine 100 in combination with other components discussed below. In some embodiments, the base 114 may include a front bar 120 and a rear bar 122 each extending along the width of the exercise machine 100. In such embodiments, the guide rails 118 may extend along the length of the exercise machine 100 between the front and rear bars 120, 122. As shown, the mast 116 may extend from (or from adjacent) the front bar 120 of the base 114. With continued reference to FIGS. 1-4, the frame 110 may be arranged to support the exercise machine 100 on a support surface.

Referring to FIGS. 1-6, the adjustment assembly 102 may include a lever arm 150 and an actuator 152. The lever arm 150 may be pivotably coupled to the frame 110. In one example, the lever arm 150 may be pivotally coupled to the mast 116. As described herein, actuation of the adjustment assembly 102 may selectively move the pivot axis 112 in more than one direction. For instance, as described more fully below, actuation of the actuator 152 may move the pivot axis 112 of the lever arm 150 along a non-linear path, such as along a curved path. One example of a curved path is showing by path 153 of FIG. 3. In such examples, pivoting movement of the lever arm 150 relative to the frame 110 may move the pivot axis 112 at least towards or away from the mast 116. The motion of the pivot axis 116 in this example is generally horizontal defining a single curve with a concave shape directed toward the base 114. The adjustment assembly 102 may be configured such that the motion of the pivot axis 112 may be generally horizontal with the concave shape directed upwardly away from the base 114, or the motion may be generally vertical in a curved path with the concave shape directed either forwardly or rearwardly relative to the exercise machine 100. Though the adjustment assembly 102 in this example is a lever arm 150, the adjustment assembly 102 may be configured in many suitable ways. For example, the adjustment assembly 102 may include more than one member. In one embodiment, the adjustment assembly 102 may include a plurality of members pivotally joined together such that the adjustment assembly 102 is a linkage assembly. As used herein, a curved path includes an arcing path.

The actuator 152 may be arranged to selectively move the lever arm 150 relative to the frame 110. For example, the lever arm 150 may include opposing first and second ends 154, 156. The lever arm 150 may be pivotably coupled to the mast 116 of the frame 110 about an adjustment axis 158 (see FIGS. 1 and 5). For example, the lever arm 150 may be pivotably coupled to the mast 116 at a position between its first and second ends 154, 156. In some embodiments, the pivot axis 112 may be arranged on the first end 154 of the lever arm 150 such that as the lever arm 150 pivots relative to the mast 116 about the adjustment axis 158, the first end 154 (and pivot axis 112) of the lever arm 150 may be moved at least towards or away from the mast 116. As shown, the lever arm 150 may be pivotably coupled to the mast 116 at a position below the pivot axis 112, though other suitable configurations are contemplated permitting the change in geometries discussed below. Depending on the particular embodiment, the lever arm 150 may have a split design including spaced-apart first and second portions 150A, 150B. This example allows portions 150A and 150B to be moved to a position surrounding or at least partially in front of the mast 116 (see FIG. 5) since the mast 116 may be received in the space formed between the portions 150A, 150B, with these portions 150A, 150B being positioned on opposing sides of the mast 116. Such a configuration may allow each foot linkage 104 to engage the adjustment assembly 102. For example, a foot linkage 104 on one side of the exercise machine 100 may engage the first portion 150A of the lever arm 150, and a foot linkage 104 on another side of the exercise machine 100 may engage the second portion 150B of the lever arm.

Turning back to FIGS. 1-6, the actuator 152 may be coupled to the second end 156 of the lever arm 150. Depending on the particular embodiment, the first and second ends 154, 156 of the lever arm 150 may be positioned on opposing sides of the mast 116. For example, the lever arm 150 may include opposing first and second portions 160, 162. In such embodiments, the first portion 160 of the lever arm 150 may be positioned on a rear side of the mast 116. The second portion 162 of the lever arm 150 may be positioned at least partially on a front side of the mast 116. In the embodiments of FIGS. 1-6, the second portion 162 of the lever arm 150 extends from the rear side of the mast 116 to the front side of the mast 116. In one embodiment, the first portion 160 extends from the adjustment axis 158 to the first end 154 of the lever arm 150 positioned rearward of the mast 116. The second portion 162 may extend from the adjustment axis 158 to the second end 156 of the lever arm 150 positioned forward of the mast 116. In such embodiments, the actuator 152 may be positioned on the front side of the mast 116 to engage the second portion 162 of the lever arm 150, which in one example may be the second end 156. In this manner, the connection point between the lever arm 150 and the actuator 152 may be positioned forward of the mast 116. Depending on the particular application, the first and second portions 160, 162 may extend at an angle to each other. For example, the first portion 160 may extend at an angle relative to the second portion 162 such that the lever arm 150 includes an L-shape. In such embodiments, the adjustment axis 158 may be positioned near the apex of the L-shaped lever arm 150.

As explained herein, the actuator 152 may be a mechanism operated manually by a user or operated electrically by a motor to selectively move the first end 154 of the lever arm 150 towards or away from the mast 116. For example, the actuator 152 may include a knob-like device or motor 172 fixedly connected to the frame 110, and in this example to the mast 116 at bracket 174 and arranged to rotate a threaded shaft 176. In some embodiments, the attachment of the actuator 152 to the bracket 174 may allow for movement of the pivot axis 112 along arcing path 153. For example, the actuator 152 may pivot relative to the bracket 174 to allow the lever arm 150 to pivot about the adjustment axis 158.

As shown, the motor 172 (or knob-like device, where applicable) may be connected to the frame 110 at a position above the adjustment axis 158. The threaded shaft 176 may extend downward or upward from the motor 172 (or knob-like device, where applicable). In one embodiment, the engagement arm 170 may include a collar 178 threaded to the threaded shaft 176 such that as the threaded shaft 176 is rotated (either manually by the user or by the motor 172), the collar 178 traverses a length of the threaded shaft 176 either towards or away from the motor 172 (or knob-like device, where applicable) fixed to the bracket 174. In the embodiments shown, as the collar 178 moves towards the motor 172 (or knob-like device, where applicable), the lever arm 150 rotates about the adjustment axis 158 to move the first end 154 (and pivot axis 112) of the lever arm 150 away from the mast 116. Similarly, as the collar 178 moves away from the motor 172, the lever arm 150 rotates about the adjustment axis 158 to move the first end 154 (and pivot axis 112) of the lever arm 150 towards the mast 116.

Depending on the position of the actuator 152 relative to the adjustment axis 158, the relative movements discussed above may be different. For instance, and without limitation, in embodiments where the threaded shaft 176 extends upwards from the motor 172, as the collar 178 moves towards the motor 172 (or knob-like device, where applicable), the lever arm 150 may rotate about the adjustment axis 158 to move the first end 154 (and pivot axis 112) of the lever arm 150 towards the mast 116, and vice-versa. The examples described above are for illustration purposes only, and other suitable configurations are contemplated.

Referring to FIGS. 1-4, the exercise machine 100 includes a coupling system 108 to at least partially define the exercise motion of the exercise machine 100. In one embodiment, with reference to FIG. 1, the coupling system 108 includes a crank 192 rotatably mounted to the frame 110, such as in one example the mast 116, about a crank axis 194. The coupling system 108 may also include first and second crank arms 196, 198 coupled to the crank 192 and rotatable about the crank axis 194. As explained below, the user may operate the exercise machine 100 to rotate the first and second crank arms 196, 198, and thereby the crank 192, about the crank axis 194 to define the exercise motion of the exercise machine 100. For example, an exercise force from the user may induce rotation of the crank 192 about the crank axis 194 to provide a reciprocating exercise motion, such as a reciprocating elliptical or circular motion, among others. As shown, the first and second crank arms 196, 198 may be positioned on opposing sides of the mast 116. In such embodiments, the crank 192 may be positioned on one side of the mast 116, such as in one example on the right side of the mast 116 along with the second crank arm 198. The crank 192 may be suitably mounted to the mast 116. For example, the crank 192 may be mounted to the mast 116 at a position above the base 114 of the frame 110. In some embodiments, the crank 192 may be mounted to the mast 116 between the base 114 and the handle linkage 106. In some embodiments, the crank 192 may be mounted to the mast 116 between the base 114 and the adjustment assembly 102.

Referring to FIGS. 1-4, the exercise machine 100 includes a foot linkage 104 coupled to the adjustment assembly 102 and to the coupling system 108. In one example, the foot linkage 104 may be coupled to the adjustment assembly 102 at the pivot axis 112 and to the crank 192, such as via a crank arm 196 or 198, such that movement of the foot linkage 104 causes corresponding movement of the crank 192, or vice-versa, as detailed below. Each foot linkage 104 may be arranged to at least partially move in a closed loop path 212 (see FIGS. 3 and 4). As explained herein, the shape of the closed loop path 212 may be altered as the adjustment assembly 102 is selectively positioned relative to the frame 110. For example, the closed loop path 212 of each foot linkage 104 may take the form of an ellipse to simulate a natural striding movement of a user's foot. Depending on the position of the adjustment assembly 102 relative to the frame 110, at least one of the major axis and the minor axis of the closed loop path 212 may vary. For example, in configurations where the first end 154 of the lever arm 150 is positioned away from the mast 116 of the frame 110, the major axis of the closed loop path 212 may extend relatively horizontal and/or may include a relatively longer length. Conversely, in configurations where the first end 154 of the lever arm 150 is positioned towards the mast 116 of the frame 110, the major axis of the closed loop path 212 may extend relatively vertical and/or may include a relatively shorter length. The minor axis may be altered similarly or inversely. For example, lengthening the major axis may shorten the minor axis. Similarly, shortening the major axis may lengthen the minor axis. In some embodiments, the relative lengths of the major and minor axes may be varied up until the minor axis is substantially equal to the major axis, or even until the minor axis is greater than the major axis, depending on the particular application.

As shown in FIGS. 1-4, each foot linkage 104 may include a reciprocating member 220 operatively associated with the coupling system 108, a foot link 222 pivotably coupled to the reciprocating member 220, and a swing arm 224 pivotably coupled to the foot link 222 and to the adjustment assembly 102 at the pivot axis 112. Each reciprocating member 220 may be movably coupled with the frame 110 and may be operatively associated with the crank 192 to reciprocally move relative to the frame 110. Each foot linkage 104 may be spaced laterally from the mast 116 to allow movement past the mast 116. For example, each foot linkage 104 may be positioned to move alongside the mast 116 during use, such as along the left and/or right side of the mast 116. In embodiments including two foot linkages 104, the foot linkages 104 may be positioned on opposing sides of the mast 116, such as on the opposing left and right sides of the mast 116.

In a preferred embodiment including two foot linkages 104, the exercise machine 100 includes first and second reciprocating members 220A, 220B each operatively associated with the crank 192 to rotate about a respective pivot axis 226, the pivot axes 226 orbiting the crank axis 194 upon rotation of the crank 192. Each of the first and second reciprocating members 220A, 220B may include opposing first and second ends 228, 230. In such embodiments, the first end 228 of each of the first and second reciprocating members 220A, 220B may be pivotably coupled to a respective one of the first and second crank arms 196, 198 at a respective pivot axis 226. The second end 230 of each of the first and second reciprocating members 220A, 220B may be arranged to reciprocally engage the frame 110 at a position rearward from the crank 192. For instance, the second ends 230 of the first and second reciprocating members 220A, 220B may reciprocally engage the guide rails 118 of the frame 110. As shown, each second end 230 includes a roller 232 arranged to roll along a respective guide rail 118 of the frame 110, though other configurations are contemplated. For example, each second end 230 may slide along or against a respective guide rail 118.

In one embodiment, the exercise machine 100 includes first and second foot links 222A, 222B operatively associated with the first and second reciprocating members 220A, 220B, respectively. In such embodiments, each of the first and second foot links 222A, 222B is arranged to reciprocally move in a respective closed loop path 212, which may be substantially identical albeit on opposing sides of the exercise machine 100. In such embodiments, selective movement of the first end 154 of the lever arm 150 towards or away from the mast 116 of the frame 110 may alter the shape of the closed loop paths 212 of the first and second foot links 222A, 222B. Each of the first and second foot links 222A, 222B may include opposing first and second ends 240, 242. The first end 240 of each foot link 222 may be pivotably coupled to a respective reciprocating member 220, such as at a pinned connection 244. As shown, each of the first and second foot links 222A, 222B may include a foot pad 246 defined or attached adjacent its first end 240 to provide a platform for a user's foot. Depending on the particular application, at least a portion of the first and second foot links 222A, 222B may be positioned outboard the first and second reciprocating members 220A, 220B. In such embodiments, the foot pads 246 of the first and second foot links 222A, 222B may extend towards each other such that the foot pads 246 are positioned above at least a portion of the first and second reciprocating members 220A, 220B, such as in one example above the second ends 230 of the first and second reciprocating members 220A, 220B.

In a preferred embodiment, the exercise machine 100 includes first and second swing arms 224A, 224B pivotally connected to the first end 154 of the lever arm 150 and operatively associated with the first and second foot links 222A, 222B, respectively. For example, the first and second swing arms 224A, 224B may be respectively coupled to the first and second foot links 222A, 222B and to the lever arm 150 of the adjustment assembly 102 to control the reciprocating movement of the first and second foot links 222A, 222B. Each of the first and second swing arms 224A, 224B may include opposing first and second ends 250, 252. The first end 250 of each swing arm 224 may be pivotally connected to the second end 242 of a respective foot link 222, such as at a pinned connection 254. The second end 252 of each swing arm 224 may be pivotably connected to the first end 154 of the lever arm 150, such as at the pivot axis 112. In such embodiments, reciprocal movement of the first and second foot links 222A, 222B may reciprocally move the first and second swing arms 224A, 224B about the pivot axis 112 of the lever arm 150.

The first and second swing arms 224A, 224B may be arranged to allow a desired spacing or geometry in the motion of each foot linkage 104 and/or handle linkage 106. For example, and without limitation, the connection between the first and second swing arms 224A, 224B and the lever arm 150 may be offset (either forwardly or rearwardly) from the second ends 252 of the swing arms 224, such as by a flange. In such embodiments, the lever arm 150 may be positioned behind the second ends 252 of each swing arm 224, though other suitable configurations are contemplated.

Depending on the particular application, the first and second swing arms 224A, 224B may facilitate the compact nature of the exercise machine 100. For example, the first and second swing arms 224A, 224B may be arcuately shaped to allow the exercise machine 100 to include a compact width. For instance, the first and second swing arms 224A, 224B may curve towards each other from their respective first ends 250 to their respective second ends 252 to reduce a width of the exercise machine 100 at least adjacent the adjustment assembly 102. As shown, the first and second swing arms 224A, 224B may be positioned such that the first and second reciprocating members 220A, 220B reciprocally move at least partially between the first and second swing arms 224A, 224B.

Referring to FIGS. 1-4 and 6, the exercise machine 100 may include a handle linkage 106 pivotably coupled to a respective foot linkage 104 such that movement of one of the foot linkage 104 and the handle linkage 106 causes corresponding movement of the other of the foot linkage 104 and the handle linkage 106. Similar to each foot linkage 104, each handle linkage 106 may be arranged to at least partially move in a defined path 272 during use of the exercise machine 100 (see FIGS. 3 and 4). Also similar to each foot linkage 104, the path 272 of each handle linkage 106 may be altered as the adjustment assembly 102 is selectively positioned relative to the frame 110. For instance, the path 272 of each handle linkage 106 may take the form of an arc to simulate a natural back and forth movement of a user's hand during exercise. Depending on the position of the adjustment assembly 102 relative to the frame 110, the arc may vary. For example, in configurations where the first end 154 of the lever arm 150 is positioned away from the mast 116 of the frame 110, the arc may extend relatively horizontal and/or may include a relatively longer arc length. In like manner, in configurations where the first end 154 of the lever arm 150 is positioned towards the mast 116 of the frame 110, the arc may extend relatively vertical and/or may include a relatively shorter arc length. Additionally or alternatively, positioning the first end 154 of the lever arm 150 towards and away from the mast 116 of the frame 110 may position a grip portion of each handle linkage 106 respectively further or closer to the support surface to match each handle linkage 106 with each foot linkage 104, such as raising and/or lengthening the arcing movement of the handle linkage 106 to correspond with a longer striding motion of the foot linkage 104, or vice-versa.

Figure 6:
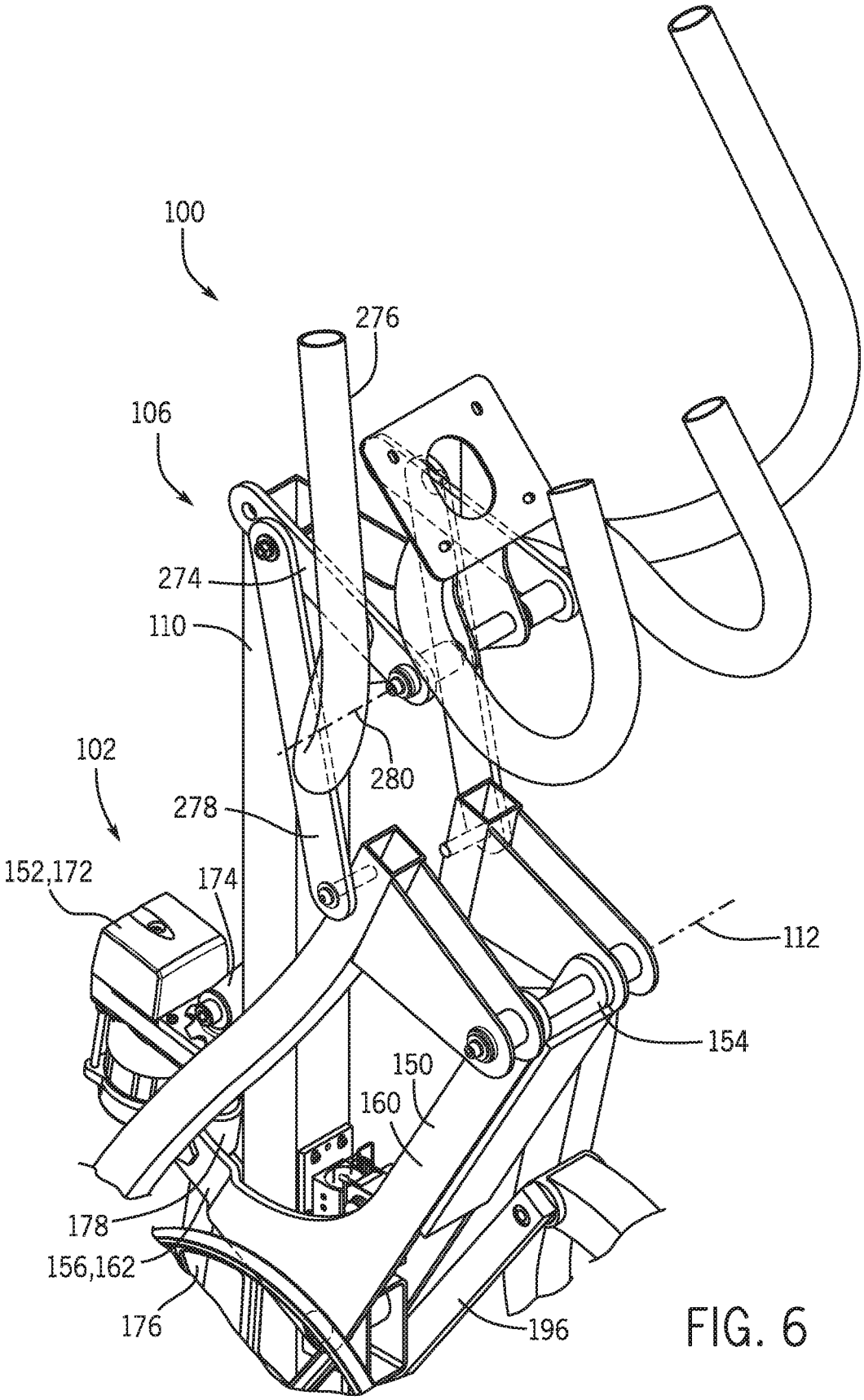
FIG. 6 is an enlarged, fragmentary view of a handle linkage of the exercise machine of FIG. 1 taken along line 6-6 of FIG. 2.

As shown in FIGS. 1, 3, and 6, each handle linkage 106 may include a swing arm link 274 pivotably coupled to the frame 110, a handle 276 coupled to the swing arm link 274, and a lever arm link 278 pivotably coupled to the swing arm link 274 and to a respective foot linkage 104. In one example, the swing arm link 274 is pivotably coupled to the mast 116. The handle 276 may be fixedly connected to the swing arm link 274. In one embodiment, each swing arm link 274 may be pivotably coupled to the frame 110 about a handle pivot axis 280 (see FIGS. 2 and 6). Depending on the particular application, the handle pivot axis 280 may be positioned above the pivot axis 112 of the adjustment assembly 102. Such a configuration may be beneficial to match the adjustment of the foot linkage 104 with the adjustment of the handle linkage 106, as explained below.

As described herein, movement of each foot linkage 104 may move the lever arm link 278 of each handle linkage 106 to rotate the swing arm link 274 about the handle pivot axis 280 to cause the handle 276 to reciprocally move in the defined path 272. For example, the exercise machine 100 may include first and second handle linkages 106A, 106B respectively coupled to the second ends 252 of the first and second swing arms 224A, 224B. In such embodiments, reciprocal movement of the first and second swing arms 224A, 224B may cause corresponding reciprocal movement of the first and second handle linkages 106A, 106B. For example, reciprocal movement of the first and second swing arms 224A, 224B about the pivot axis 112 may cause corresponding reciprocal movement of each swing arm link 274 of the first and second handle linkages 106A, 106B about the handle pivot axis 280. In this manner, the movement of corresponding foot and handle linkages 104, 106 may be tied together to match a natural foot and hand exercise movement. For instance, the handle 276 of each handle linkage 106 may move towards the user as the foot link 222 of the corresponding foot linkage 104 moves forward towards the front of the exercise machine 100. Similarly, the handle 276 of each handle linkage 106 may move away from the user as the foot link 222 of the corresponding foot linkage 104 moves rearward towards the rear of the exercise machine 100.

Operation of the exercise machine 100 will now be discussed in more detail with reference to FIGS. 3 and 4. During operation, a climbing or striding motion by the user results in the displacement of the second ends 230 of the first and second reciprocating members 220A, 220B along the guide rails 118 (such as in the direction of arrow 300). As the second ends 230 of the first and second reciprocating members 220A, 220B reciprocally move along the guide rails 118, the first ends 228 of the first and second reciprocating members 220A, 220B orbit the crank axis 194 of the crank 192 via connection of the first and second reciprocating members 220A, 220B to the crank 192 via the first and second crank arms 196, 198. The second ends 230 of the first and second reciprocating members 220A, 220B may move in opposing directions during operation of the exercise machine 100 to simulate a natural striding movement. For example, when the second end 230 of the first reciprocating member 220A moves towards the rear of the exercise machine 100, the second end 230 of the second reciprocating member 220B may move towards the front of the exercise machine 100, and vice-versa.

Reciprocal movement of the first and second reciprocating members 220A, 220B relative to the frame 110 causes the first and second foot links 222A, 222B to move generally in the direction of arrow 302. More particularly, the first ends 240 of the first and second foot links 222A, 222B move in an elliptical closed loop path 212 simulating a natural striding motion. As the first ends 240 of the first and second foot links 222A, 222B move in elliptical paths, the second ends 242 of the first and second foot links 222A, 222B generally reciprocally move in the direction of arrow 304, although some arcing movement may also occur depending on the particular geometries of the various elements. In such embodiments, the reciprocal movement of the first and second foot links 222A, 222B relative to the frame 110 causes the first and second swing arms 224A, 224B to reciprocally rotate about the pivot axis 112 of the lever arm 150 in the direction of arrow 306.

As the first and second swing arms 224A, 224B reciprocally rotate about the pivot axis 112 of the lever arm 150, the lever arm link 278 of each handle linkage 106 reciprocally moves generally up and down in the direction of arrow 308. Because the swing arm link 274 of each handle linkage 106 is connected to a respective lever arm link 278, the reciprocal movement of the lever arm link 278 in the direction of arrow 308 causes the swing arm link 274 of each handle linkage 106 to reciprocally rotate about the handle pivot axis 280 in the direction of arrow 310. As the swing arm link 274 of each handle linkage 106 reciprocally rotates about the handle pivot axis 280, the handle 276 of each handle linkage 106 reciprocally moves about the handle pivot axis 280 along an arcing path (such as in the direction of arrow 312).

At any point of operation, the user may operate the adjustment assembly 102 to effectuate a change in the closed loop path 212 of each foot linkage 104 as well as in the arcing path 272 of each handle linkage 106. For example, the user may actuate the actuator 152 to move the first end 154 of the lever arm 150 towards or away from the mast 116 of the frame 110, such as via the exemplary threaded shaft/collar structure discussed above. As explained above, movement of the first end 154 of the lever arm 150 towards the mast 116 of the frame 110 alters the closed loop path 212 of each foot linkage 104 and the arcing path 272 of each handle linkage 106 in a first manner. The closed loop path 212 may be altered in many ways, such as for example by one or more of lengthening the stride of each foot linkage 104, increasing the arc length of each handle linkage 106, and/or orienting the paths of each foot linkage 104 and handle linkage 106 more horizontally. Conversely, movement of the first end 154 of the lever arm 150 away from the mast 116 of the frame 110 alters the closed loop path 212 of each foot linkage 104 and the arcing path 272 of each handle linkage 106 in a second manner, such as for example by one of or more of shortening the stride of each foot linkage 104, decreasing the arc length of each handle linkage 106, and/or orienting the paths of each foot linkage 104 and handle linkage 106 more vertically. The user may actuate the adjustment assembly 102 until a desired characteristic is achieved, such as finding a configuration in which the exercise device provides a natural and/or comfortable geometric motion for the user.

Figure 2:
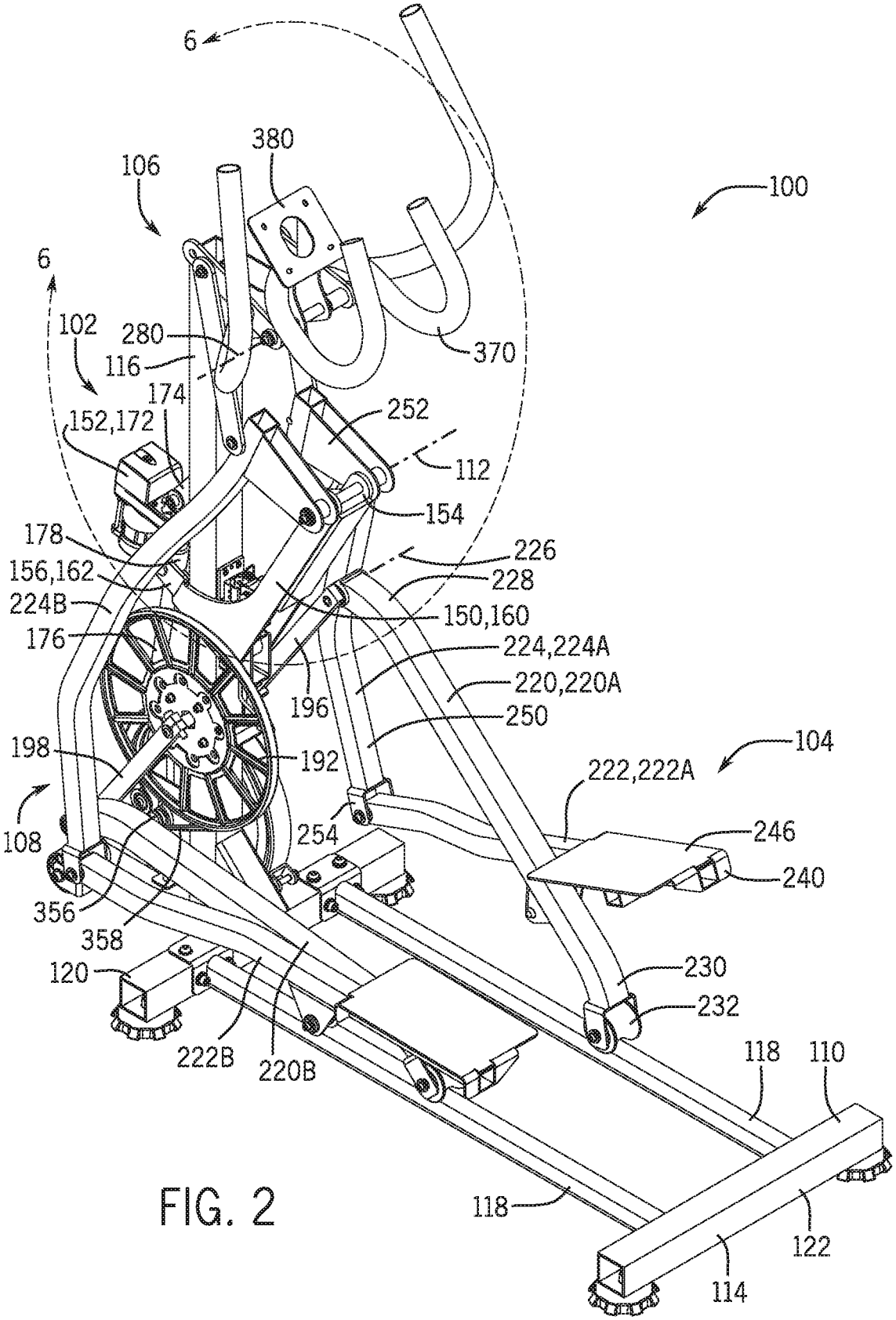
FIG. 2 is a rear isometric view of the exercise machine of FIG. 1.
Figure 3:
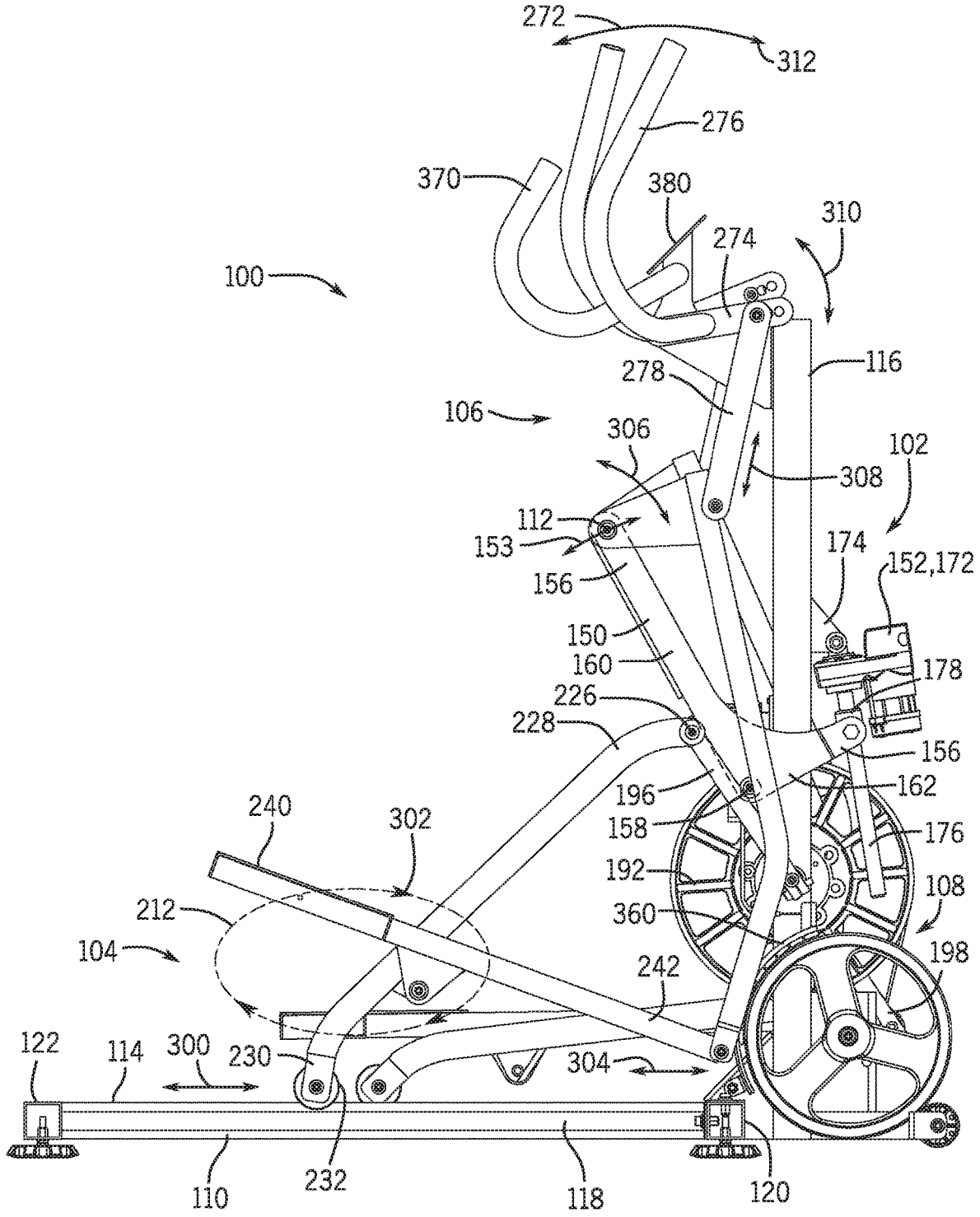
FIG. 3 is a side elevation view of the exercise machine of FIG. 1 in a first configuration.
Figure 4:
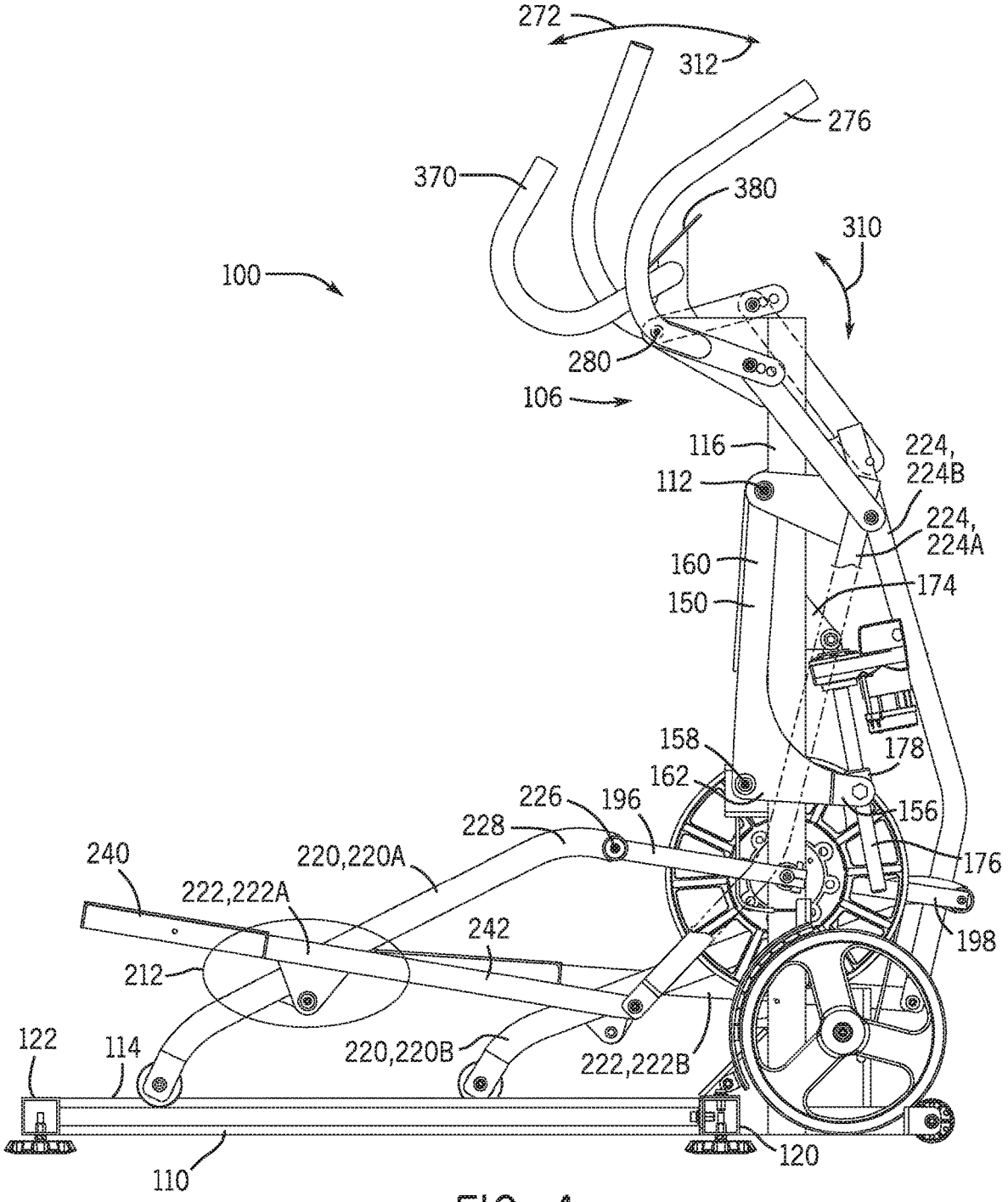
FIG. 4 is a side elevation view of the exercise machine of FIG. 1 in a second configuration.
Figure 5:
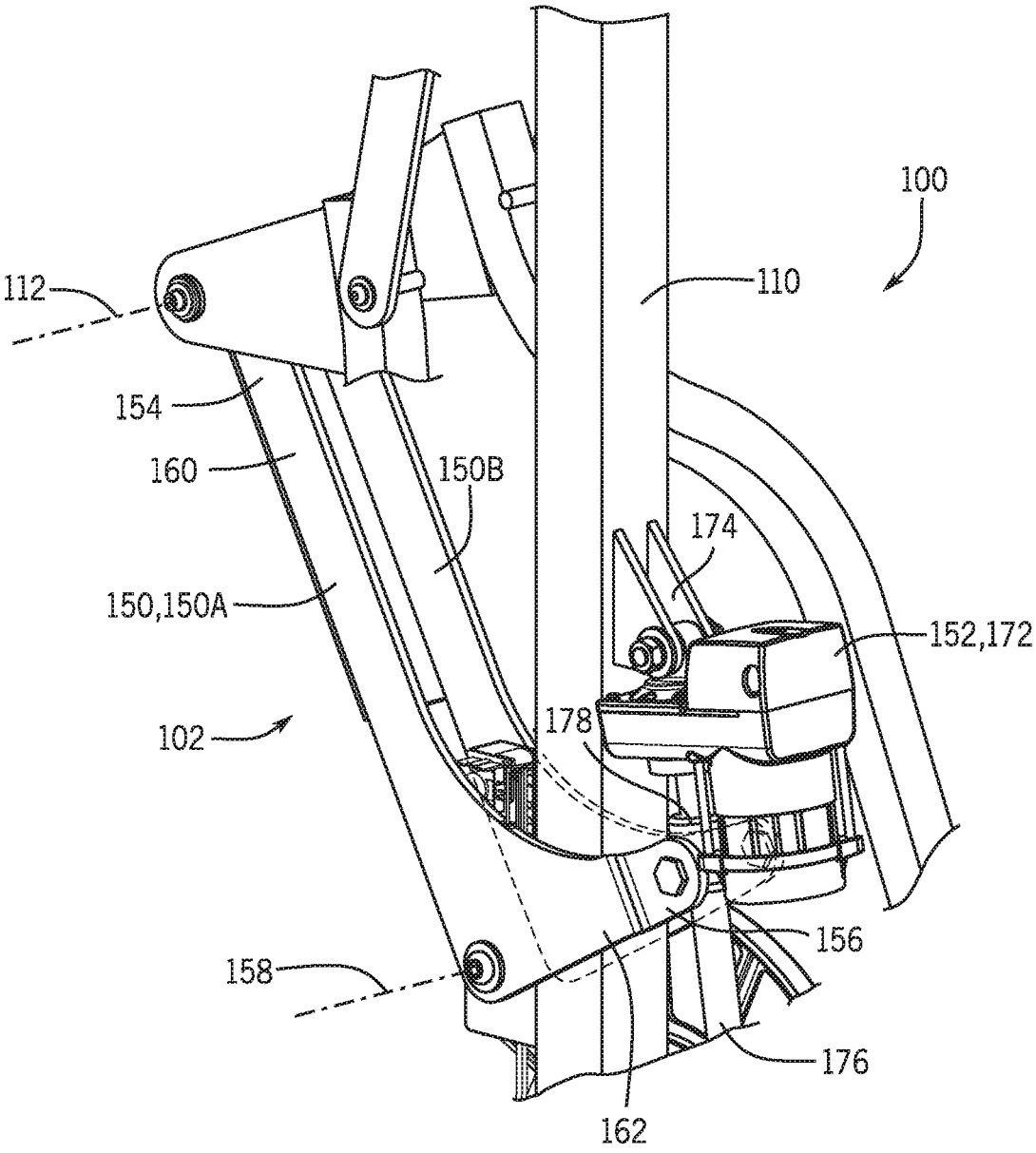
FIG. 5 is an enlarged, fragmentary view of an adjustment assembly of the exercise machine of FIG. 1 taken along line 5-5 of FIG. 1.

Referring to FIGS. 1-3, the exercise machine 100 may include other features for convenience. For example, the exercise machine 100 may include a resistance assembly 350 (see FIG. 1) operatively associated with the crank 192. As one example, the resistance assembly 350 may include a flywheel 352 rotatably coupled to the frame 110. In one example, the flywheel 352 may be rotatably coupled about an axle to the mast 116. A gear or pulley 356 (see FIG. 2) may be coupled to the axle to rotate with the flywheel 352. In such embodiments, a chain or belt 358 may rotationally connect the crank 192 with the gear/pulley 356 such that rotation of the crank 192 rotates the gear/pulley 356 to rotate the flywheel 352. To provide a degree of rotational resistance, a braking operation may be applied to the crank 192, such as via the flywheel 352. In one embodiment, one or more brake pads 360 (see FIG. 3) may apply selective friction against the flywheel 352, such as against the rim of the flywheel 352, to provide a varying degree of rotational resistance. Other braking configurations are contemplated, including a rotating air-resistance based fan-like mechanism, a magnetism based eddy current mechanism, or the like.

In some embodiments, the exercise machine 100 may include a pair of secondary handles 370. The secondary handles 370 may be fixedly connected to the frame 110, such as for example that mast, such that movement of the foot linkages 104 and/or handle linkages 106 does not move the secondary handles 370. The secondary handles 370 may provide a secondary gripping location for a user should the user desire not to hold onto the moving handle linkages 106. In some embodiments, the exercise machine 100 may include a mounting plate 380 attached to the frame 110. The mounting plate 380, which may be positioned on the mast 116 and adjacent the handle linkages 106 and/or the secondary handles 370, may provide a surface to attach various components and/or devices to the exercise machine 100. For example, a control device, such as a console or a computing device, such as for example a smartphone, a laptop, a tablet, or the like, may be attached to the mounting plate 380 to control the exercise machine 100 and/or provide feedback to a user during exercise. Though not shown, various components of the exercise device may be covered by shrouding to protect the user and/or bystanders. For example, at least portions of the adjustment assembly 102, the coupling system 108, the resistance assembly 350, and/or the mast 116, among others, may be covered with shrouding to protect the user against moving parts and/or provide a desired aesthetic characteristic to the exercise device.

Figure 7:
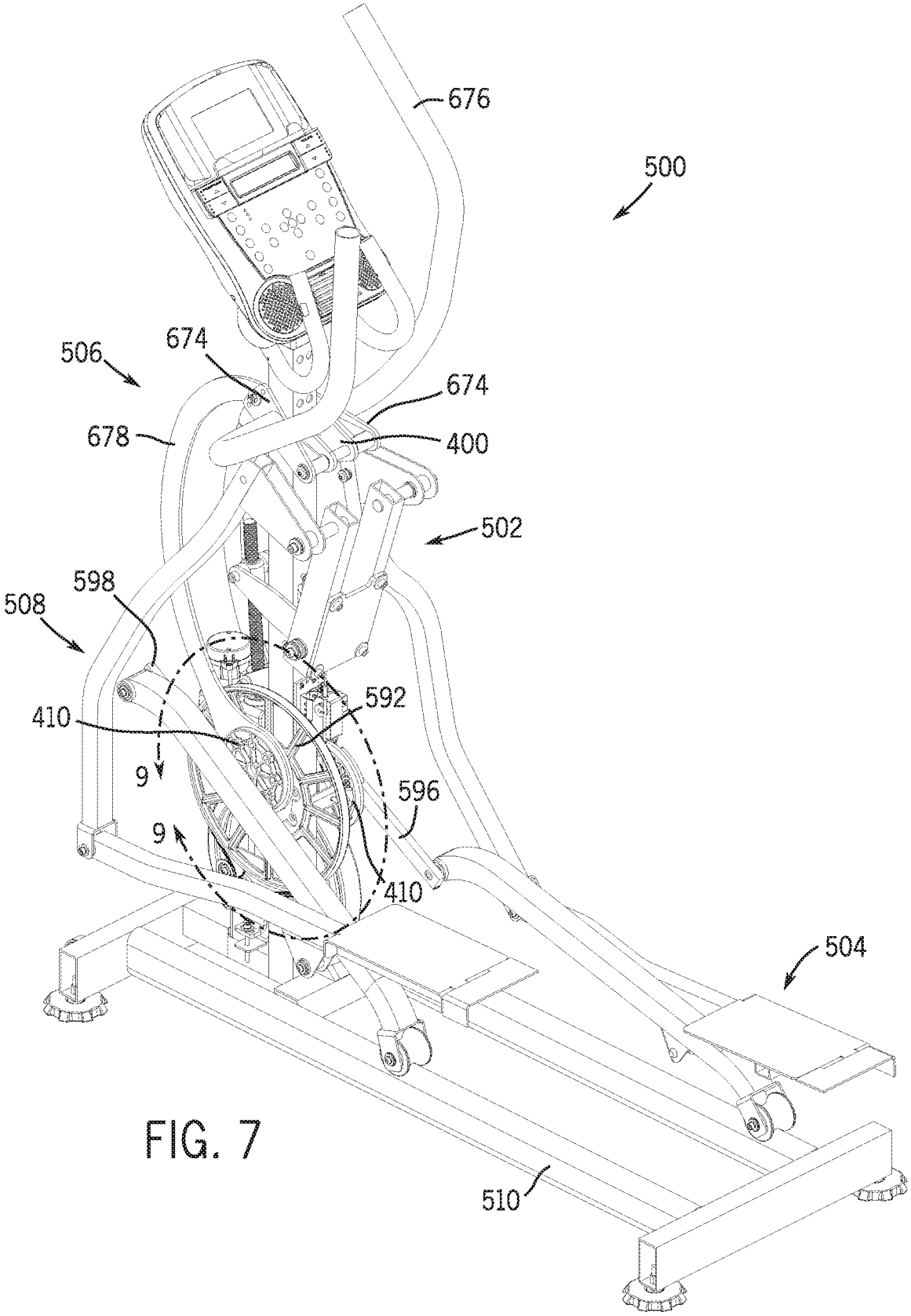
FIG. 7 is a rear isometric view of another example of an exercise machine.
Figure 8:
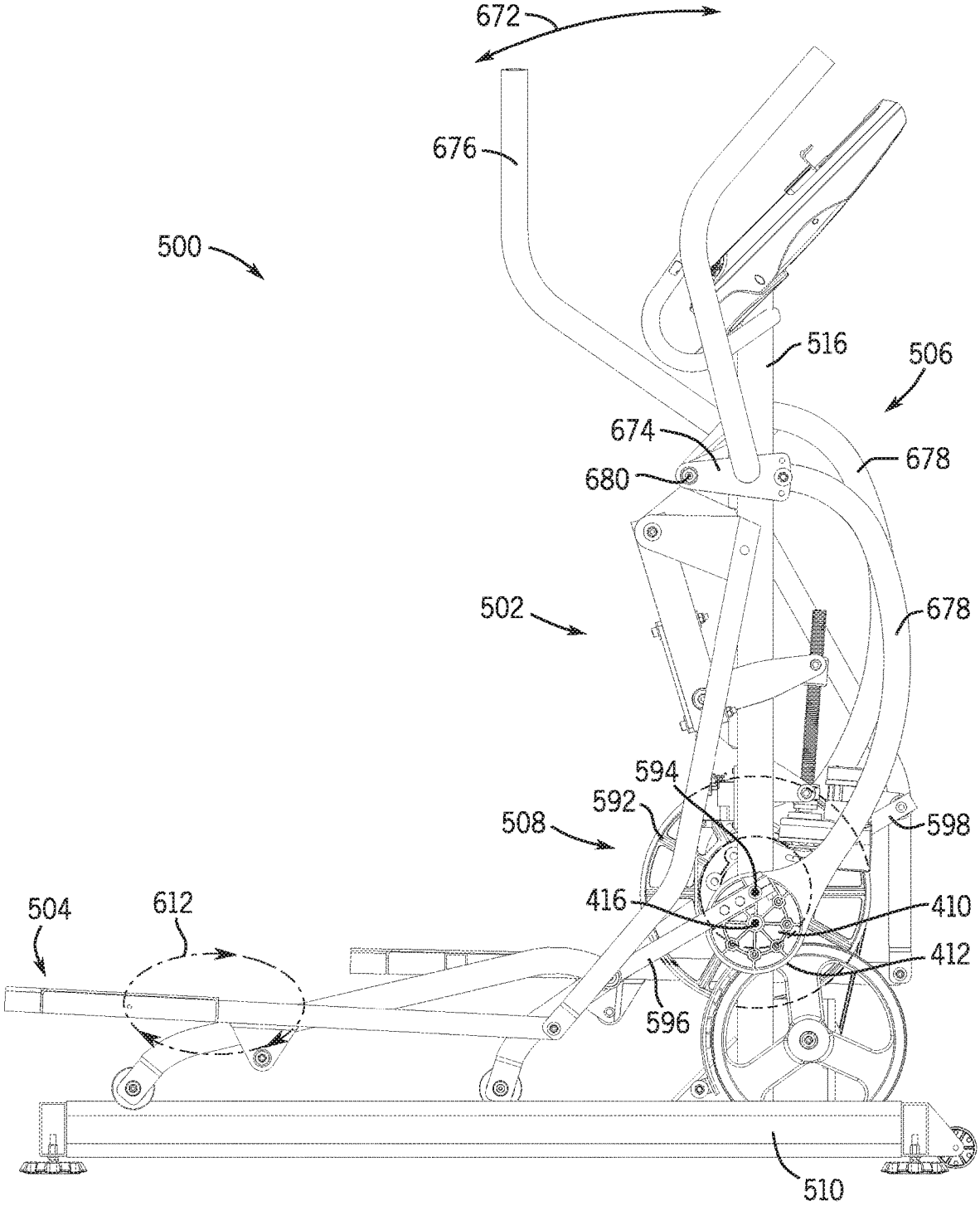
FIG. 8 is a side elevation view of the exercise machine of FIG. 7.
Figure 9:
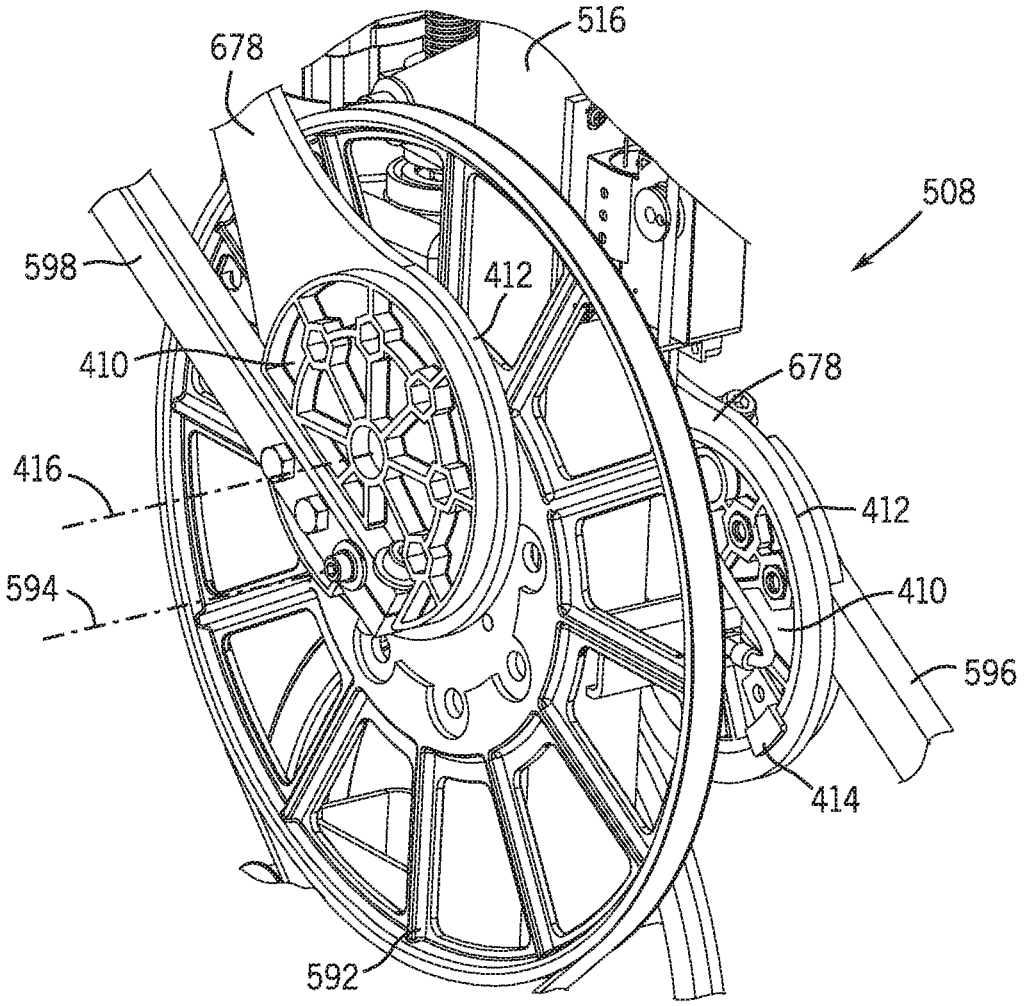
FIG. 9 is an enlarged, fragmentary view of a handle linkage connection of the exercise machine of FIG. 7 taken along line 9-9 of FIG. 7.

FIGS. 7-9 illustrate another embodiment of an exercise machine 500. Except as otherwise noted below, the exercise machine 500 is similar to the exercise machine 100 described above. Accordingly, in certain instances, like features will not be discussed when they would be apparent to those skilled in the art in light of the description above and in view of FIGS. 7-9. For ease of reference, like structure is represented with appropriately incremented reference numbers.

Referring to FIGS. 7-9, each handle linkage 506 may be decoupled from the adjustment assembly 502 such that movement of the adjustment assembly 502 does not affect the position and/or the movement of the handle linkage 506. For instance, each handle linkage 506 may be movably coupled to an element of the exercise machine 500 separate from the adjustment assembly 502. In such embodiments, movement of the adjustment assembly 502 relative to the frame 510 may alter the motion of each foot linkage 504 only. In this example, selective positioning of the adjustment assembly 502 relative to the frame 510, such as in the manner described above, may alter the closed loop paths 612 of the foot linkages 504, but the reciprocating path 672 of the handle linkages 506 may be unaffected.

As one example, illustrated in FIGS. 7-9, each handle linkage 506 may be pivotably coupled to the frame 510 (e.g., to the mast 516) and movably coupled to the coupling system 508. For example, the swing arm link 674 of each handle linkage 506 may be pivotably coupled to the frame 510, such as to a bracket 400 extending from the mast 516. In one embodiment, the bracket 400 may offset the connection between the handle linkages 506 and the frame 510, such as offsetting the connection either forwardly or rearwardly of the mast 516, although other configurations are contemplated. As shown, each swing arm link 674 may extend forward of the bracket 400. With continued reference to FIGS. 7-9, the lever arm link 678 may be pivotably coupled to the swing arm link 674 and movably coupled to the coupling system 508. For example, and without limitation, each lever arm link 678 may be movably coupled to the crank 592 and/or a respective crank arm 596 or 598 such that movement of the crank 592 causes reciprocal movement of each handle linkage 506, as explained below.

In one embodiment, the exercise machine 500 may include a pair of disks 410 coupled to the coupling system 508. For example, the disks 410, which may be referred to as bearings, may be coupled to the crank 592 such that the disks 410 rotate with the crank 592. In this way, the disks 410 may rotate in unison with the crank 592 around the crank axis 594. As shown, the disks 410 may be positioned on opposing sides of the exercise machine 500, such as adjacent the first and second crank arms 596, 598. For example, each disk 410 may be positioned between the mast 516 and a respective crank arm 596 or 598. As further example, a disk 410 may be positioned between the crank 592 and an adjacent crank arm 596 or 598. In the example shown in FIGS. 7-9, the disks 410 are coupled by being fixed relative to the crank 592.

Each lever arm link 678 may be configured to movably engage a respective disk 410. As one example, the lower ends of each lever arm link 678 may include an annular collar 412. In such embodiments, the disks 410 are rotatably mounted within the annular collars 412. In such embodiments, the disks 410 may rotate relative to the lever arm links 678 and the annular collars 412. The coupling arrangement between the disks 410 and the annular collars 412 may permit each annular collar 412 to rotate about a respective disk 410 while simultaneously limiting axial movement of each annular collar 412 away from its respective disk 410. For instance, each annular collar 412 may be mounted to a bearing surface of a respective disk 410. In one embodiment, the bearing surface of each disk 410 may be defined as a channel formed between an annular flange defined on a front side of the disk 410 and a tab 414 (or plurality of tabs 414) positioned on a rear side of the disk 410 (see FIG. 9). In such embodiments, each annular collar 412 may be positioned at least partially between the tab 414 and an adjacent crank arm 596 or 598, such as within a channel defined between the annular flange and the one or more tab 414. In such embodiments, relative movement between the annular collars 412 and the disks 410 may be constrained to the space between the tab 414 and the adjacent crank arm 596 or 598. For instance, each annular collar 412 may rotate relative to its respective disk 410 only within the space between the tab 414 and the adjacent crank arm 596 or 598.

As described herein, the handle linkages 506 may be eccentric linkages. As one example, the disks 410 may be eccentrically mounted to the coupling system 508 to cause the reciprocal movement described above of each handle linkage 506. For example, the disks 410 may be mounted to the coupling system 508 such that a center axis 416 of each disk 410 is spaced away from the crank axis 594 (see FIG. 9). In such embodiments, the disks 410 at least partially orbit the crank axis 594 upon rotation of the crank 592 to cause the annular collar 412 of each lever arm link 678 to also orbit the crank axis 594. For example, the orbital movement of each annular collar 412 about the crank axis 594 may rotate the swing arm links 674 about the handle pivot axis 680 to cause the handles 676 to reciprocally move in the defined path 672 (see FIG. 8).

Similar to the exercise machine 100 described above, the handle linkage 506 may be movably coupled to the exercise machine 500 such that movement of one of the foot linkage 504 and the handle linkage 506 causes corresponding movement of the other of the foot linkage 504 and the handle linkage 506. For example, because the handle linkages 506 are eccentrically coupled to the coupling system 508 (e.g., to the crank 592 and/or the first and second crank arms 596, 598), movement of the handle linkages 506 may drivingly rotate the crank 592 to cause the reciprocal movement of the foot linkages 504 described above. Alternatively, rotation of the crank 592 (such as via movement of the foot linkages 504) may reciprocally move the handle linkages 506 in the manner described above.

The lever arm links 678 may be arranged to allow a desired spacing or geometry in the motion of each handle linkage 506. For example, the lever arm links 678 may be arcuately shaped to allow the exercise machine 500 to include a compact dimension (e.g., a compact length). For instance, each lever arm link 678 may be convexly-shaped with a curve extending away from the exercise machine 100 (such as away from the center of the exercise machine 500). The exercise machine 500 may be configured similarly to the exercise machine 100 in some or all other aspects.

Figure 10:
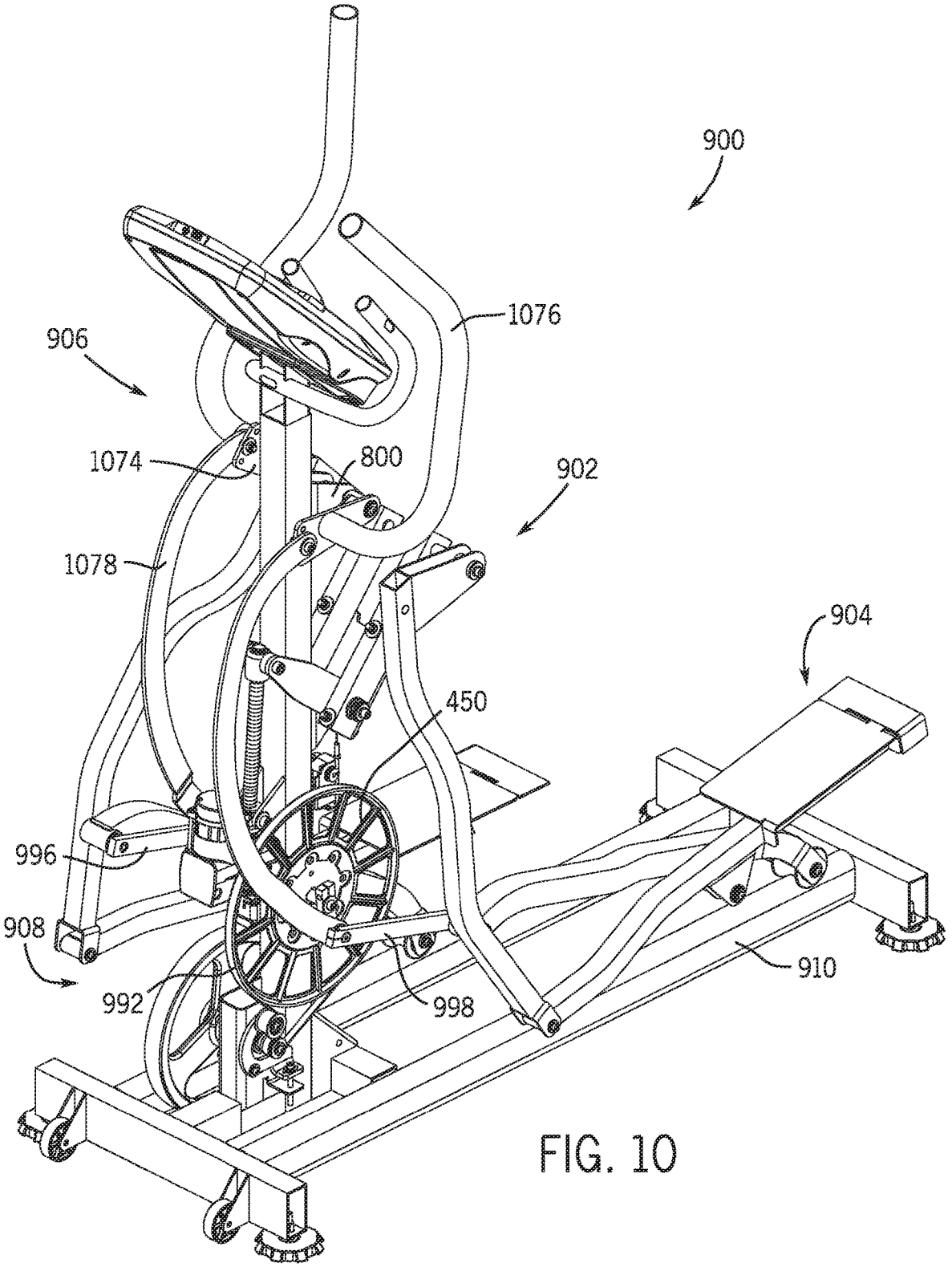
FIG. 10 is a front isometric of another example of an exercise machine.
Figure 11:
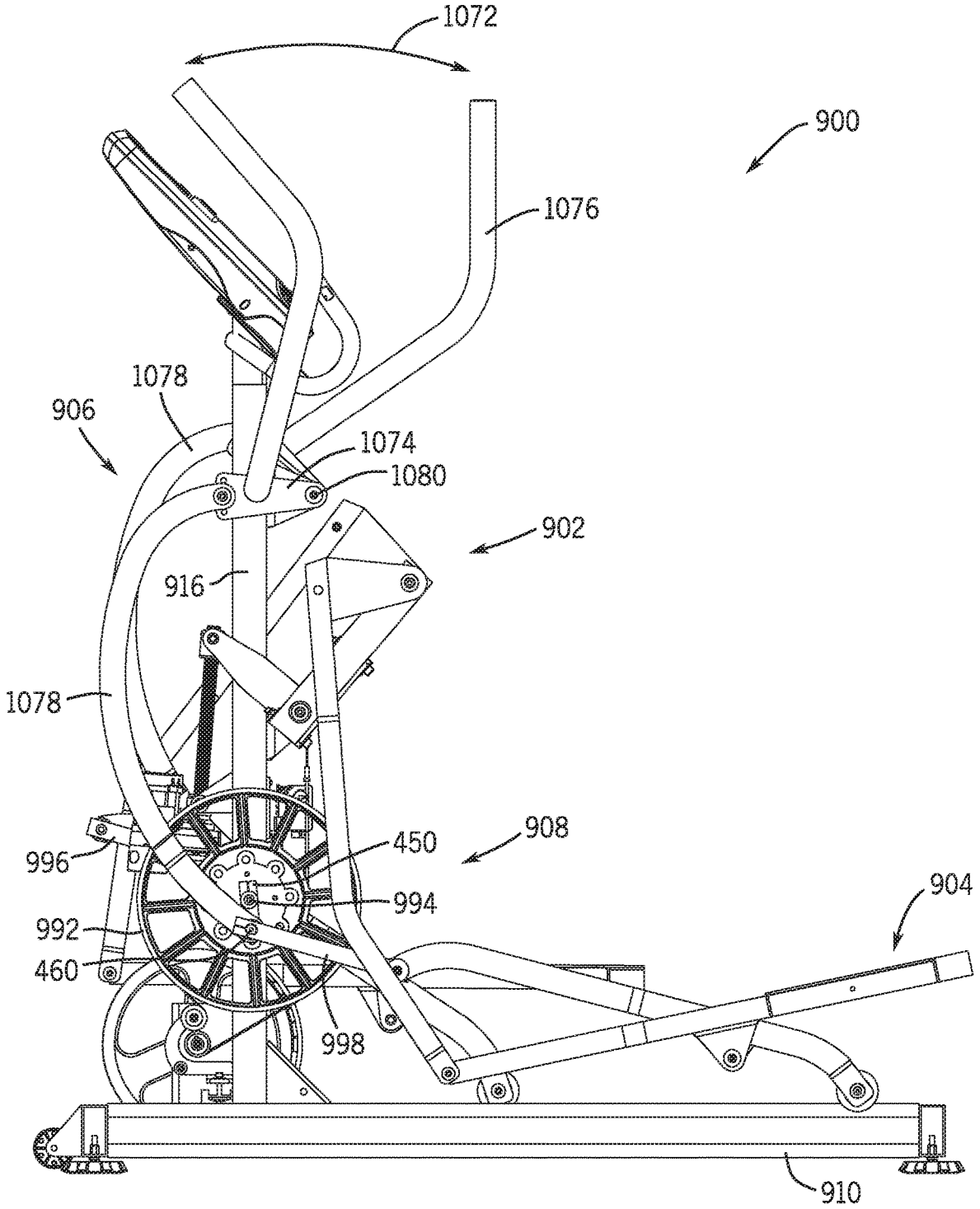
FIG. 11 is a side elevation view of the exercise machine of FIG. 10.
Figure 12:
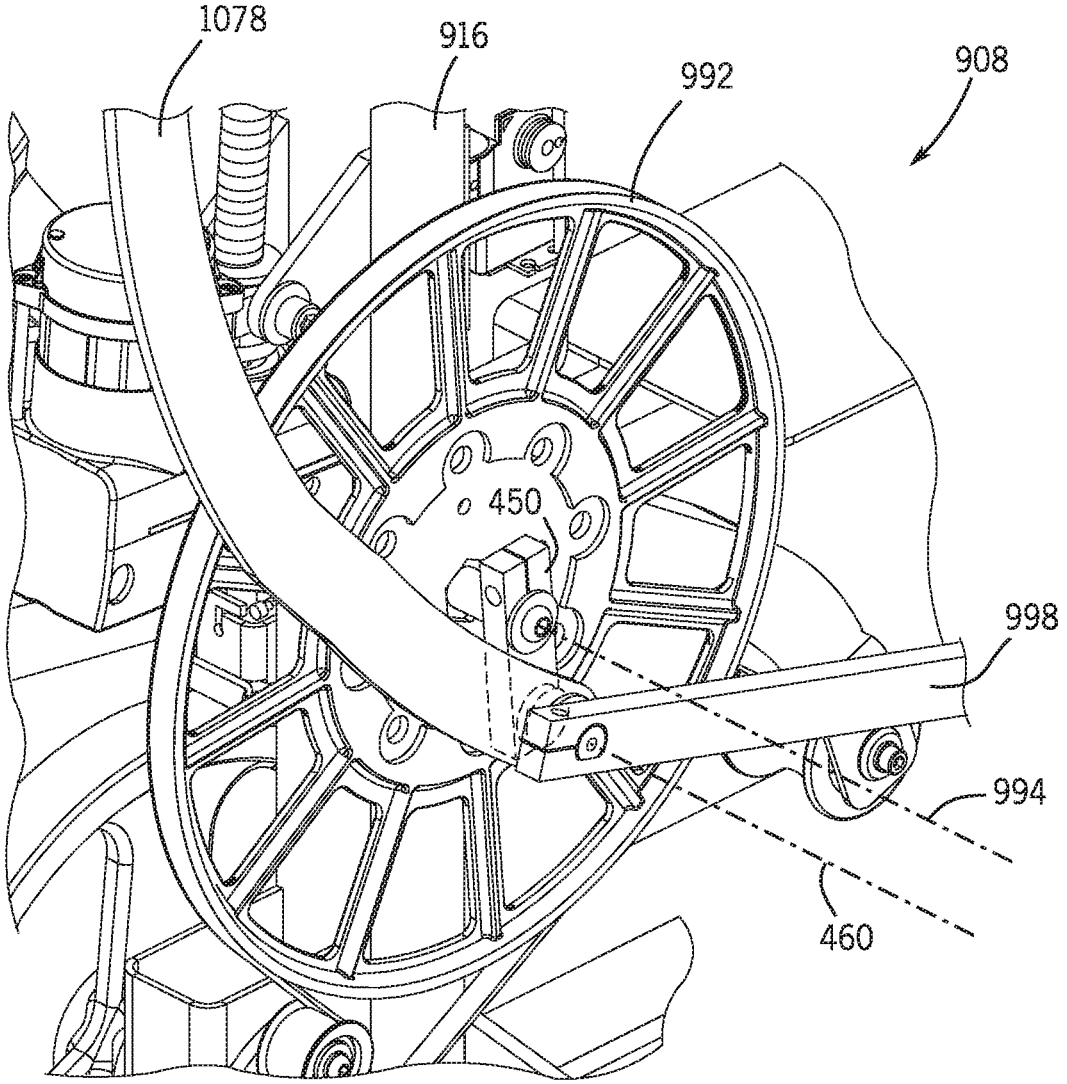
FIG. 12 is an enlarged, fragmentary view of a handle linkage connection of the exercise machine of FIG. 10 taken along line 12-12 of FIG. 10.

FIGS. 10-12 illustrate another embodiment of an exercise machine 900. Except as otherwise noted below, the exercise machine 900 is similar to the exercise machines 100 and 500 described above. Accordingly, in certain instances, like features will not be discussed when they would be apparent to those skilled in the art in light of the description above and in view of FIGS. 10-12. For ease of reference, like structure is represented with appropriately incremented reference numbers.

Similar to the exercise machine 500, each handle linkage 906 of the exercise machine 900 may be decoupled from the adjustment assembly 902, such as to an element of the exercise machine 900 separate from the adjustment assembly 902, such that movement of the adjustment assembly 902 does not affect the position and/or the movement of the handle linkage 906. In this way, movement of the adjustment assembly 902 relative to the frame 910 may alter the motion of each foot linkage 904 only, with the reciprocating path 1072 of the handle linkages 906 substantially unaffected.

Similar to the exercise machine 500, each handle linkage 906 may be pivotably coupled to the frame 910 (e.g., to the mast 916) and movably coupled to the coupling system 908. Like the exercise machine 500, the swing arm link 1074 of each handle linkage 906 may be pivotably coupled to the frame 910 (e.g., to the bracket 800 extending from the mast 916). In such embodiments, the lever arm link 1078 of each handle linkage 906 may be pivotably coupled to the swing arm link 1074 and movably coupled to the coupling system 908 such that movement of the coupling system 908 causes reciprocal movement of each handle linkage 906, as explained below.

Referring to FIGS. 10-12, the exercise machine 900 may include a pair of bar links 450 coupled to the coupling system 908. For example, the bar links 450 may be coupled to the crank 992 such that the bar links 450 rotate with the crank 992 about the crank axis 994. The bar links 450 may be positioned similarly to the disks 410 discussed above. For instance, the bar links 450 may be positioned between the mast 916 and a respective crank arm 996 or 998. In the examples shown in FIGS. 10-12, the bar links 450 are coupled by being fixed relative to the crank 992.

Each lever arm link 1078 may be configured to movably engage a respective bar link 450. As one example, the lower ends of each lever arm link 1078 may be pivotably coupled to the bar links 450. In one embodiment, the lever arm links 1078 may be pivotably coupled to the bar links 450 at respective pivot axes 460. As shown, the pivot axes 460 may be defined on the bar links 450 at a positioned spaced away from the crank axis 994. In such embodiments, the pivot axes 460 orbit the crank axis 994 upon rotation of the crank 992 to cause the lower end of each lever arm link 1078 to also orbit the crank axis 994. In this manner, the orbital movement of the lower ends of the lever arm links 1078 about the crank axis 994 may reciprocally rotate the swing arm links 1074 about the handle pivot axis 1080 to cause the handles 1076 to reciprocally move in the defined path 1072 (see FIG. 11).

Referring to FIGS. 10-12, the first and second crank arms 996, 998 may be movably coupled to the bar links 450. For example, in one embodiment, the first and second crank arms 996, 998 may be pivotably coupled to the bar links 450 at the pivot axes 460. In such embodiments, the first and second crank arms 996, 998 may orbit the crank axis 994 upon rotation of the crank 992. In this manner, the connection of the foot and handle linkages 904, 906 to the crank 992 may be considered a lobed crank connection. For example, the pivot axis 460 may be defined by structure similar to a crank lobe. In such embodiments, the crank arms 996, 998 and the lower ends of the lever arm links 1078 may rotate about the crank lobe as the crank lobe orbits the crank axis 994.

Similar to the exercise machines 100 and 500 described above, the handle linkage 906 may be movably coupled to the exercise machine 900 such that movement of one of the foot linkage 904 and the handle linkage 906 causes corresponding movement of the other of the foot linkage 504 and the handle linkage 906. For example, because the handle linkages 906 are eccentrically coupled to the coupling system 908 (such as via the bar links 450), movement of the handle linkages 906 may drivingly rotate the crank 992 to cause the reciprocal movement of the foot linkages 904 described above. Alternatively, because the foot linkages 904 are eccentrically coupled to the coupling system 908 (such as via the bar links 450), movement of the foot linkages 904 may drivingly rotate the crank 992 to cause the reciprocal movement of the handle linkages 906 described above. The exercise machine 900 may be arranged similar to the exercise machines 100 and 500 in other respects, where appropriate or desired.

The exercise machine 100, 500, 900 may be formed from a variety of materials and means. For instance, the frame 110, 510, 910, the adjustment assembly 102, 502, 902, the foot linkages 104, 504, 904, and the handle linkages 106, 506, 906, among others, may be formed from metal, plastic, or any other suitable material with sufficient strength. In some embodiments, the frame 110, 510, 910, the foot linkages 104, 504, 904, and the handle linkages 106, 506, 906 may be extruded from metal or another thermoformable material. Metals may include aluminum, steel, titanium, or any other suitable metal, alloy, or composite.

All relative and directional references (including: upper, lower, upward, downward, left, right, leftward, rightward, top, bottom, side, above, below, front, middle, back, vertical, horizontal, and so forth) are given by way of example to aid the reader's understanding of the particular embodiments described herein. They should not be read to be requirements or limitations, particularly as to the position, orientation, or use unless specifically set forth in the claims. Connection references (e.g., attached, coupled, connected, joined, and the like) are to be construed broadly and may include intermediate members between a connection of elements and relative movement between elements. As such, connection references do not necessarily infer that two elements are directly connected and in fixed relation to each other, unless specifically set forth in the claims.

Those skilled in the art will appreciate that the presently disclosed embodiments teach by way of example and not by limitation. Therefore, the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall there between.

What is claimed is:

1. An exercise machine comprising:

a frame;

an adjustment assembly coupled to the frame and selectively movable relative thereto, the adjustment assembly including a pivot axis;

a foot linkage arranged to reciprocally move in a closed loop path, the foot linkage pivotably coupled to the adjustment assembly at the pivot axis such that selective movement of the pivot axis relative to the frame alters the closed loop path of the foot linkage in use; and a handle linkage arranged to reciprocally move in a defined path, wherein movement of one of the foot linkage and the handle linkage causes corresponding movement of the other of the foot linkage and the handle linkage;

wherein actuation of the adjustment assembly selectively moves the pivot axis along a curve with a concave shape directed toward a base of the frame.

2. The exercise machine of claim 1, wherein:

the frame includes a mast positioned adjacent the front of the exercise machine; and the pivot axis is positioned rearward of the mast.

3. The exercise machine of claim 2, wherein:
the adjustment assembly includes an actuator operable to move the pivot axis relative to the mast.

4. The exercise machine of claim 3, wherein:
the adjustment assembly includes a lever arm pivotably coupled to the mast; and
the actuator is arranged to move the lever arm relative to the mast; and
the actuator is attached to the mast such that the actuator and the pivot axis are positioned on opposing sides of the mast.

5. The exercise machine of claim 4, wherein:
the lever arm includes opposing first and second ends;
the pivot axis is arranged on the first end of the lever arm; and
the actuator is coupled with the second end of the lever arm.

6. The exercise machine of claim 5, wherein:
the lever arm includes opposing first and second portions extending at an angle to each other;
the first portion of the lever arm is positioned on a rear side of the mast; and
the second portion of the lever arm extends from the rear side of the mast to a front side of the mast.

7. An exercise machine comprising:
a frame including a mast positioned adjacent the front of the exercise machine;
a lever arm pivotally connected to the mast such that a first end of the lever arm is selectively moved towards or away from the mast;
a crank rotatably mounted to the mast about a crank axis;
first and second reciprocating members operatively associated with the crank to rotate about a respective pivot axis, the pivot axes orbiting the crank axis upon rotation of the crank;
first and second foot links operatively associated with the first and second reciprocating members, respectively, each of the first and second foot links arranged to move in a respective closed loop path; and
first and second swing arms pivotally connected to the first end of the lever arm and operatively associated with the first and second foot links, respectively;
wherein selective movement of the first end of the lever arm towards or away from the mast alters the closed loop paths of the first and second foot links.

8. The exercise machine of claim 7, further comprising first and second crank arms coupled to the crank and rotatable about the crank axis, wherein the first and second reciprocating members are pivotally connected to the first and second crank arms, respectively.

9. The exercise machine of claim 8, wherein the first and second crank arms are eccentrically coupled to the crank such that the connection of the first and second crank arms to the crank orbits the crank axis upon rotation of the crank.

10. The exercise machine of claim 7, further comprising an actuator coupled with a second end of the lever arm and arranged to selectively move the first end of the lever arm at least towards or away from the mast.

11. The exercise machine of claim 10, wherein:
the first end of the lever arm is positioned on one side of the mast; and
the actuator is positioned on an opposite side of the mast.

12. The exercise machine of claim 11, wherein the first end of the lever arm is positioned on a rear side of the mast.

13. The exercise machine of claim 7, further comprising first and second handle linkages respectively coupled to the second ends of the first and second swing arms such that movement of the first and second swing arms causes corresponding movement of the first and second handle linkages.

14. The exercise machine of claim 7, further comprising first and second handle linkages eccentrically coupled to the crank such that rotation of the crank causes orbital movement of at least a portion of the first and second handle linkages about the crank axis.

15. An exercise machine comprising:
a frame;
a lever arm pivotally connected to the frame and selectively positioned relative to the frame;
a crank rotatably mounted to the frame about a crank axis;
first and second crank arms coupled to the crank and rotatable about the crank axis;
first and second reciprocating members each including opposing first and second ends, the first end of each reciprocating member pivotably coupled to a respective crank arm, the second end of each reciprocating member arranged to reciprocally engage the frame at a position rearward from the crank;
first and second foot links respectively coupled to the first and second reciprocating members and arranged to reciprocally move in respective closed loop paths; and
first and second swing arms respectively coupled to the first and second foot links and to the lever arm to control the reciprocating movement of the first and second foot links.

16. The exercise machine of claim 15, further comprising first and second handle linkages arranged to reciprocally move in defined paths, wherein the first and second handle linkages are respectively coupled to the first and second swing arms such that movement of the first and second swing arms causes corresponding movement of the first and second handle linkages.

17. The exercise machine of claim 16, wherein the first and second handle linkages are eccentrically coupled to the crank such that rotation of the crank causes orbital movement of a portion of each of the first and second handle linkages about the crank axis.

18. The exercise machine of claim 17, further comprising a pair of disks eccentrically coupled to the crank and rotatably mounted within respective annular collars included in the first and second handle linkages such that orbital movement of the disks about the crank axis causes reciprocal movement of the first and second handle linkages.

19. The exercise machine of claim 17, further comprising a pair of bar links coupled to the crank and defining respective pivot axes spaced away from the crank axis, the first and second handle linkages coupled to a respective pivot axis to at least partially orbit the crank axis.

20. The exercise machine of claim 15, wherein the frame comprises:
a base including a plurality of guide rails with which the second ends of the first and second reciprocating members reciprocally engage;
a mast extending vertically from the base, the lever arm pivotally connected to mast; and
an actuator arranged to selectively move a first end of the lever arm towards or away from the mast.

* * * * *